United States Patent [19]

Bailey

[11] 4,359,864

[45] Nov. 23, 1982

[54] BURN-OUT TYPE CLEANING MEANS FOR PARTICULATE FILTER OF ENGINE EXHAUST SYSTEM

[75] Inventor: John M. Bailey, Dunlap, Ill.

[73] Assignee: Caterpillar Tractor Co., Peoria, Ill.

[21] Appl. No.: 275,077

[22] PCT Filed: Feb. 5, 1981

[86] PCT No.: PCT/US81/00167

§ 371 Date: Feb. 5, 1981

§ 102(e) Date: Feb. 5, 1981

[51] Int. Cl.[3] ..... B01D 39/20; F01N 3/02

[52] U.S. Cl. ..... 60/311; 55/272; 55/283; 55/DIG. 30

[58] Field of Search ..... 60/295, 296, 300, 303, 60/311; 55/283, 272, 301, DIG. 10, DIG. 30

[56] References Cited

U.S. PATENT DOCUMENTS

| | | | |
|---|---|---|---|
| 2,495,635 | 1/1950 | Hersey | 55/283 |
| 3,957,639 | 5/1976 | Schoen | 55/272 |
| 4,167,852 | 9/1979 | Ludecke | 60/311 |
| 4,270,936 | 6/1981 | Mann | 60/311 |
| 4,276,066 | 6/1981 | Bly | 60/311 |

*Primary Examiner*—Douglas Hart

*Attorney, Agent, or Firm*—Wegner, Stellman, McCord, Wood & Dalton

[57] ABSTRACT

Apparatus for raising the temperature of internal combustion engine exhaust gases high enough to burn collected particulate material from particulate filter means (27/56) in the exhaust system. An electrical resistance heating element (37/71) which confronts only a small part of the inlet surface of particulate filter means (27/56) is moved relative to said inlet surface so as to progressively and cyclically burn the particulates from the filter means.

9 Claims, 4 Drawing Figures

BURN-OUT TYPE CLEANING MEANS FOR PARTICULATE FILTER OF ENGINE EXHAUST SYSTEM

DESCRIPTION

1. Technical Field

This invention relates to a device for cleaning particulates from a filter which removes them from exhaust gases of engines, such as diesel engines, by burning out the collected particulates.

2. Background Art

Internal combustion engines, and particularly diesel engines, emit exhaust gases that carry substantial amounts of particulate material. Such material adds to the air pollution produced by internal combustion engines which lack an effective particulate filter.

A problem with most particulate filters is that they gradually become clogged with particulates in operation which causes excessive back pressure resulting in poor engine performance or damage to the engine or the filter.

Sometimes when an internal combustion engine is operating under heavy load, the exhaust gases enter the particulate filter at a high enough temperature to burn out particulates collected by it; but when an engine is operated for protracted periods of time at, or close to its idling speed, particulate buildup may be so heavy as to impede engine operation.

An engine exhaust particulate filter structure heretofore developed by applicant relieves part of the problem of particulate collection by permitting opposed filter elements to move apart sufficiently to eliminate excessive back pressure. However, even a particulate filter of the structure there described may require a supplemental means for heating the engine exhaust gases sufficiently to ignite and burn out particulates collected by the filter.

The foregoing illustrates limitations of the known prior art. Thus, it is apparent that it would be advantageous to provide an alternative directed to overcoming one or more of the problems set forth above. The only system of which applicant is aware which is intended to perform the foregoing operation utilizes two particulate filters which are used alternately. When one filter is blocked, flow is switched to the other filter and a heater is energized to burn out the first filter. Upon excessive blockage of the second filter, flow is returned to the first filter and a second heating element goes into operation to burn out the second filter.

DISCLOSURE OF THE INVENTION

In accordance with the present invention, burnout type cleaning means is provided for an engine exhaust particulate filter which has filter means of a material capable of operating at a temperature range above about 1000° F. through which exhaust gases pass from an inlet surface through an opposite surface so the filter means traps particulates in the gases. The cleaning means includes an electric resistance heating element which is constructed and arranged to confront only a small part of the one surface of the filter means, drive means for moving the heating element so that it confronts all parts of the one surface of the filter means in a regular cycle, and means for energizing the heating element to raise the temperature of gases passing over it to a level at which the gases ignite particulates trapped in the filter. This permits the cleaning means to cyclically burn particulates out of the entire filter means by igniting the particulates at and directly inward from the part of the filter means surface which is confronted by the heating element from time to time.

THE DRAWINGS

BEST MODE FOR CARRYING OUT THE INVENTION

Figures 1, 2:
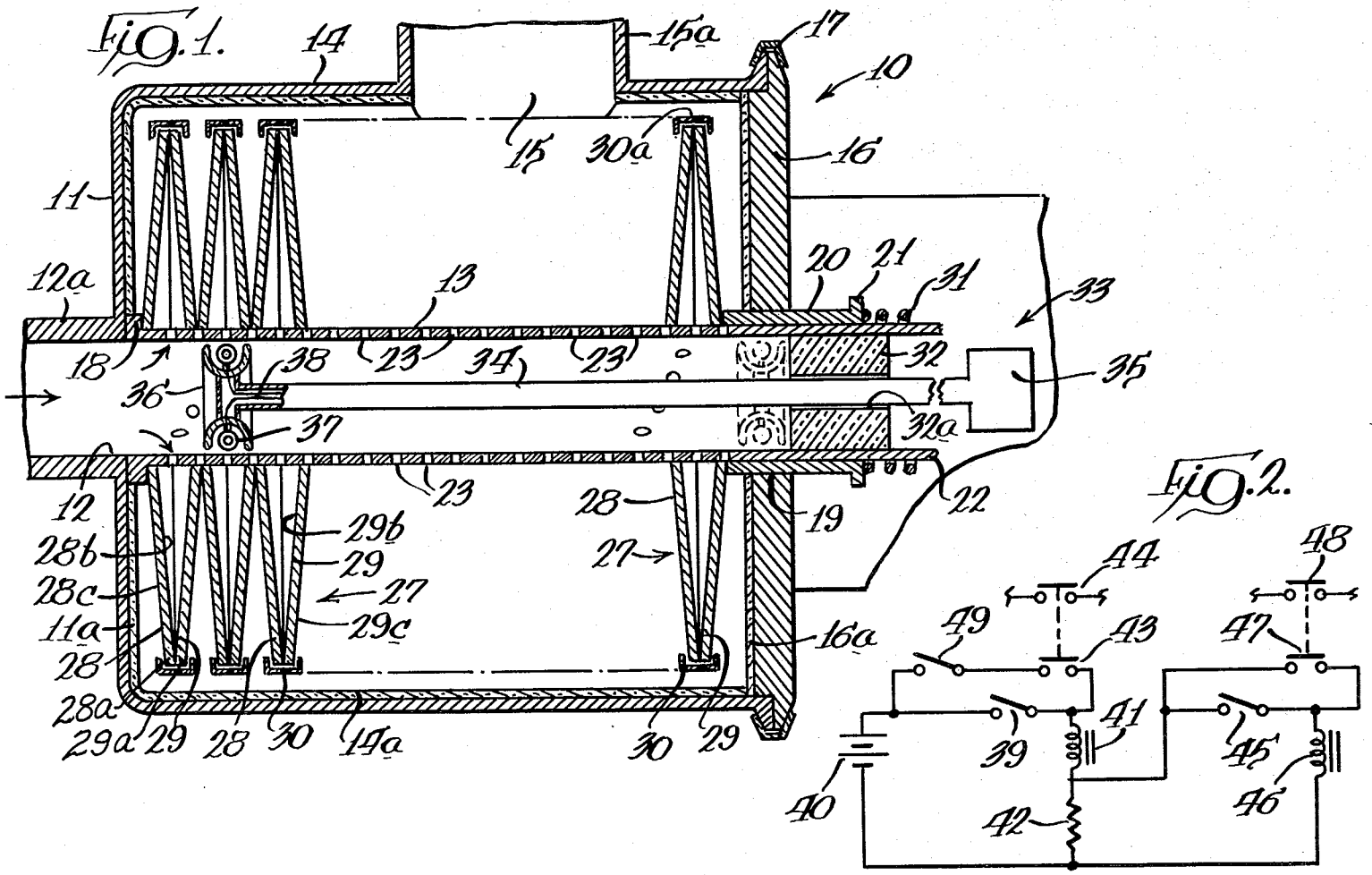
FIG. 1 is a longitudinal, central sectional view of a cleaning means embodying the present invention, as applied to a particulate filter heretofore developed by applicant.
FIG. 2 is an electrical circuit diagram of a control circuit for the cleaning means illustrated in FIG. 1.

Referring to the drawings in detail, and referring first to FIG. 1, a housing, indicated generally at 10, has an inlet end wall 11 provided with an inlet opening 12 through which a pipe 12*a* delivers exhaust gases to a fluid conducting manifold 13. A cylindrical housing side wall 14 has an opening 15 communicating with a discharge pipe 15*a;* and the end of the housing opposite the wall 11 is supplied with a closure plate 16 which may conveniently removably mounted upon the end of the cylindrical housing side wall 14 by a collar 17, although other common means may be used such as screws or bolts in overlapping circumferential flanges. Preferably the housing 10 is fabricated from sheet metal which is protected from the corrosive effect of hot exhaust gases by ceramic lining elements 11*a,* 14*a* and 16*a* on the respective end wall 11, cylindrical side wall 14, and end plate 16.

Suitable means such as an abutment 18 is employed to fixedly secure one end of the manifold 13 to the end wall 11, and the opposite end portion of the manifold 13 extends through an axial hole 19 in the end plate 16 and the ceramic liner 16*a.* A sleeve 20 having a thrust ring 21 makes a sliding fit on an outer end portion 22 of the manifold 13.

Within the housing 10 the manifold 13 is foraminous by reason of series of foramina, certain ones of which are indicated by the reference numeral 23.

Surrounding the manifold is at least one and preferably a plurality of pairs of filter means indicated generally at 27, axially disposed along manifold 13 within housing 10. Each of the filter means consists of two opposed, radially extending filter elements 28 and 29 having inner periphery encircling the manifold 13 adjacent the foramina 23. The filter elements 28,29 comprise relatively thin plates of porous, preferably refractory material which are spaced apart adjacent the manifold 13 and which converge toward each other as they extend radially outwardly from manifold 13 and have outer peripheral portions 28*a* and 29*a* lightly in contact with one another for inhibiting fluid flow between elements 28,29. As shown in FIG. 1, a perforated annular clip 30, which may conveniently be in the form of a split collar having a plurality of openings 30*a* formed therein, loosely embraces the contacting outer peripheral portions 28*a* and 29*a* of the filter elements to permit the peripheral portions 28*a* and 29*a* to separate slightly in response to pressure changes in exhaust gases between the elements 28,29. The filter elements 28 and 29 may consist of a material such, for example, as ceramic, compressed stainless steel wire, foamed metal, or any other material which may be fabricated into a plate having pores small enough to effectively filter soot particles as small as 0.01 to 1 micron in diameter. The filter elements 28 and 29 have respective inlet surfaces 28*b* and 29*b*, and opposite surfaces 28*c* and 29*c*.

The filter means 27 are held firmly in stacked relationship between the sleeve 20 and the annular abutment 18 by means of a spring 31.

An annular ceramic plug 32 closes the manifold 13 and has an opening 32*a* to receive the cleaning means of the present invention.

The apparatus as disclosed up to this point is essentially that of applicant's exhaust particulate filter structure heretofore referred to.

The cleaning means of the present invention as constructed for use with the hereinabove described particulate filter is indicated generally at 33. An elongated, hollow heating element support rod 34 makes a snug sliding fit in the opening 32*a* in the annular ceramic plug 32, and drive means, indicated schematically at 35, operatively engages the rod 34 so as to reciprocate it endwise in the manifold 13.

Supported at the outer end of the rod 34 is an annular shroud member 36, and surrounding the shroud member is an annular electrical resistance heating element 37 of known type. Electrical wires 38 for the heating element extend through the hollow rod 34 and are connected to a source of electric energy such as a motor vehicle battery.

The shroud 36 associated with the heating element 37 restricts the flow of gases around the heating element so as to provide quite intensive heating of a rather small volume of gas which then passes through the immediately adjacent foramina 23 of the manifold 13 and into one of the pairs of filter means 27 which is directly confronted by the electric resisting heating element 37.

The drive means 35 is of any suitable type to reciprocate the rod 34 slowly between the ends of the manifold 13, so that particulates are cyclically burned out of the filter elements 28 and 29 by igniting the particulates at and directly internally of the filter element inlet surfaces 28*b* and 29*b* which are confronted by the heating element 37 from time to time.

The hollow rod 34 occupies an inactive position in which the heating element 37 is in the broken line position of FIG. 1, so that it is ordinarily out of the path of exhaust gases entering the manifold. The drive means 35 and electrical heating element 37 may be energized to move the heating element slowly to the left as seen in FIG. 1, and then return it to the broken line parking position. This may be done on a time cycle, so that the cleaning means is automatically operated after a predetermined number of hours of engine operation.

Preferably, however, the actuation of the cleaning means 33 is by a pressure-actuated switch which closes when the pressure drop from the inlet pipe 12*a* to the discharge pipe 15*a* reaches a predetermined level indicating excessive back pressure upon the engine.

FIG. 2 illustrates a circuit which may be employed to produce the operation hereinabove described. When back pressure reaches a desired limit, a pressure-sensitive switch 39 is closed so that current may flow from a battery 40 to a solenoid 41 and a resistance 42. Energization of solenoid 41 closes holding contacts 43 and contacts 44 which initiate the burn-out process by starting an electric motor which is part of the drive means 35 and energizing the electrical heating element 37. When the rod 34 reaches its extreme left-hand position as seen in FIG. 1, a limit switch 45 is momentarily closed, causing the voltage created across the resistor 42 to cause current to flow through the switch 45 and through a second solenoid 46 back to the battery 40. Energization of solenoid 46 closes holding contact 47 and a motor reversing switch 48. The motor is then driven in reverse, causing the hollow rod 34 to move to the right in FIG. 1. When the electrical resistance element 37 of the cleaning apparatus again reaches the broken line position of FIG. 1, a limit switch 49 is opened. The filter is now cleaned, a procedure requiring about one hour, so the back pressure is below that required to operate the pressure switch 39, and with switch 49 also open the solenoid 41 is deenergized, the holding contacts 43 are opened, and current through the resistor 42 is terminated. This also deenergizes solenoid 46, permitting the system to remain with the electrical resistance heating element 37 in the broken line position of FIG. 1 until the pressure switch 39 is again closed.

Figures 3, 4:
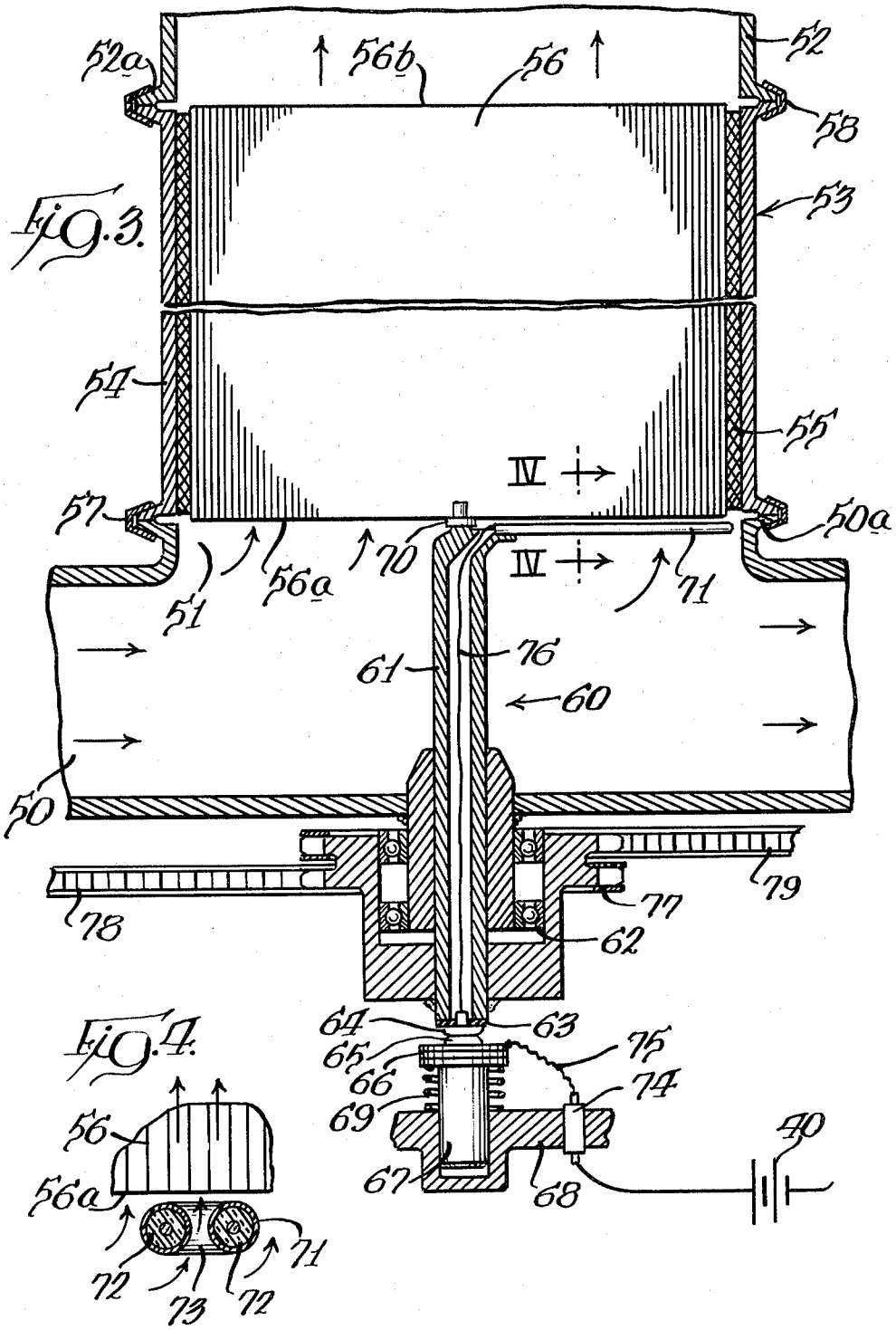
FIG. 3 is a central sectional view of a cleaning means embodying the invention, as applied to a particulate filter of another type.
FIG. 4 is a fragmentary sectional view on an enlarged scale taken substantially as indicated along the line IV—IV of FIG. 3.

Referring now to FIG. 3, an internal combustion engine exhaust manifold 50 has an inlet opening 51 which communicates with an exhaust stack 52 through a particulate filter, indicated generally at 53. The filter 53 comprises a shell 54 within which is a stainless steel wire netting 55 that supports honeycomb particulate filter means 56 having an inlet surface 56*a* and an opposite surface 56*b*. Preferably the particulate filter means 56 is a porous, ceramic material which is available from Corning Glass Works, and which was particularly designed for filtering fine particulate material from a gaseous stream. The filter member 53 is secured between a flange 50*a* on the exhaust manifold outlet 51 and a flange 52*a* on the exhaust stack by means of clamps 57 and 58, so that it is readily removable for servicing or replacement.

Burn-out type cleaning means, indicated generally at 60, consists of a hollow shaft providing support means which is rotatably mounted in bearings 62. At the outer end of the shaft 61 is an annular insulator 63 in which an electrically conductive button 64 is mounted. The button rests upon a conductor button 65 which is carried upon an insulator 66 at the upper end of a plunger 67 which seats in an adaptor 68. A compression spring 69 surrounding the plunger 67 bears upon a flange at the top of the plunger to maintain the electrical contact buttons 64 and 65 in firm contact and also to maintain thrust of the hollow shaft 61 upwardly against a small metallic button 70 which is mounted at the bottom of the filter means 56 and on the longitudinal axis of the shell 54.

An electrical resistance heating element 71 is U-shaped, so that it has parallel arms 72 connected by a bight 73, and the heating element 71 is supported upon the hollow shaft 61 in close proximity to the bottom of the filter means 56 and extending radially from the shaft. An energizing circuit for the resistance heating element 71 includes a terminal 74, a wire 75 which is connected to the electrically conductive button 65, and an internal wire 76 which connects the electrically conductive button 64 and the heating element 71.

The shaft 61 is rotated slowly so that the electrical resistance element 71 traverses the inlet surface 56*a* of the filter means 56; and such rotation may be accomplished by any desired drive means which, in the illustrated embodiment, consists of a cluster sprocket 77 which is connected by a drive chain 78 with an electric motor (not shown), and which in turn is connected by a drive chain 79 with another sprocket for a shaft of another heating element which is associated with an additional filter member such as the filter member 53.

Although the apparatus is here illustrated as having more than one filter member 53, it is perfectly apparent that there might be a single filter member, in which event a single sprocket would be substituted for the cluster sprocket 77, and the exhaust manifold would be closed off to the right of the filter member 53.

Operation of the apparatus of FIG. 3 may be continuous, or it may be in accordance with a time cycle as previously stated with respect to the apparatus of FIG. 1. Preferably, however, a pressure-sensitive actuating switch is employed to start the drive of the shaft 61 and energize the heating element 71 when the pressure drop between the exhaust manifold 50 and the vent stack 52 reaches a predetermined high value, indicating excessive blockage of the filter means 56 by particulates. The control circuit is, of course, far simpler than that illustrated in FIG. 2, because the hollow shaft 61 may be rotated always in the same direction, and all that is necessary is to stop the motor and deenergize the heating element when the latter has rotated 360°.

The foregoing detailed description has been given for clearness of understanding only, and no unnecessary limitations should be understood therefrom as modifications will be obvious to those skilled in the art.

I claim:

1. In an engine exhaust particulate filter (10/53) including filter means (27/56) for trapping particulates as exhaust gas passes from an inlet surface (**28*b*–29*b*/56*a*) to an opposite surface (28*c*–29*c*/56*b***) thereof, the improvement comprising:

electrical heating element means (32/71) for heating the exhaust gas passing to a localized portion of said inlet surface (**28*b*–29*b*/56*a*) of said filter means (27/56) to a level at which said gases ignite particulates trapped in the filter means (27/56**);

and drive means (35/77) for moving said electrical heating element means (37/71) confrontingly in immediate juxtaposition to said entire inlet surface (**28*b*–29*b*/56*a*) so the locally heated exhaust gas progressively ignites the particulates trapped in the entire filter means (27/56) as said electrical hating element means (37/71) moves confrontingly over said inlet surface (28*b*–29*b*/56*a***).

2. The combination of claim 1 in which the filter means (56) has a circular inlet surface (**56*a*), support means (61) for one end of the electrical heating element means (71) is close to said circular inlet surface (56*a*) and aligned with the center (70) thereof, said heating element (71) extends radially from said support (61), and the drive (77–78) means rotates the heating element (71) about said support means (61**).

3. The combination of claim 2 in which the support means (61) is a tube, electrical connections (76) for the electrical heating element means (71) extend through said tube, and there is a rotary electrical contact (63–64) at the end of the tube (61) remote from the electrical heating element means (71).

4. The combination of claim 1 in which the particulate filter (10) includes a manifold (13) which has a foraminous wall, the filter means (27) comprises a multiplicity of pairs of filter elements (28–29) extending laterally from said manifold (13) so that exhaust gases pass through the foramina (23) of the manifold (13) and then from the inlet surface (**28*b*–29*b*) through one or another of said filter elements (28–29), in which the electrical heating element means (37) is within the manifold, and in which the drive means (35) reciprocates the electrical heating element means (37) along the manifold (13) to confront the inlet surfaces (28*b*–29*b*) of said multiplicity of pairs of filter elements (28–29**) seriatim.

5. The combination of claim 4 which includes a support (34) for the electrical heating element means (37) which has a longitudinal axis essentially parallel to the foraminous wall, and the electrical heating element means (37) is in a plane substantially perpendicular to said axis, and said electrical heating element means (37) is narrow and confronts only a few of said foramina (23) at any one time.

6. The combination of claim 5 in which the foraminous manifold wall is a right circular cylinder, the filter elements (28–29) surround said cylinder, the support (34) for the electrical heating element means (37) is a rod effectively on the longitudinal axis of said cylinder, and the electrical heating element means (37) is an annulus effectively concentric with the foraminous wall.

7. The combination of claim 6 which includes a shroud (36) operatively associated with the electrical heating element means (37) to limit the flow of gases around said element (37).

8. The combination of claim 1 or 2 or 4 or 6 which includes an electrical control circuit for the drive means (35/77) and for the electrical heating element means (37/71) energizing means including a pressure-sensitive switch (39) to initiate operation of the cleaning means responsive to a predetermined pressure drop across the filter means (37/56).

9. In an engine exhaust particulate filter (10/53) including filter means (27/56) for trapping particulates as exhaust gas passes from an inlet surface (**28*b*–29*b*/56*a*) to an opposite surface (28*c*–29*c*/56*b***) thereof, the improvement comprising:

heating means (37/71) for heating the exhaust gas passing to a localized portion of said inlet surface (**28*b*–29*b*/56*a*) of said filter means (27/56) to a level at which said gas ignites particulates trapped in the filter means (27/56); and drive means (37/77) for moving said heating means (37/71) confrontingly in immediate juxtaposition to said entire inlet surface (28*b*–29*b*/56*a*) so the locally heated exhaust gas progressively ignites the particulates trapped in the entire filter means (27/56**).

* * * * *